US011427956B2

(12) United States Patent
Lai et al.

(10) Patent No.: US 11,427,956 B2
(45) Date of Patent: Aug. 30, 2022

(54) FABRIC STEAMER APPARATUS

(71) Applicant: Conair LLC, Stamford, CT (US)

(72) Inventors: Kin Man Lai, Wu Kai Sha (HK); Anthony Kit Lun Leung, North Point (HK)

(73) Assignee: Conair LLC, Stamford, CT (US)

( * ) Notice: Subject to any disclaimer, the term of this patent is extended or adjusted under 35 U.S.C. 154(b) by 0 days.

(21) Appl. No.: 16/853,532

(22) Filed: Apr. 20, 2020

(65) Prior Publication Data

US 2021/0324571 A1 Oct. 21, 2021

(51) Int. Cl.

| | |
|---|---|
| ***D06F 75/32*** | (2006.01) |
| ***D06F 75/16*** | (2006.01) |
| ***D06F 75/20*** | (2006.01) |
| ***D06F 75/30*** | (2006.01) |
| ***D06F 73/00*** | (2006.01) |
| ***D06F 87/00*** | (2006.01) |

(52) U.S. Cl.

CPC ..... *D06F 75/32* (2013.01); *D06F 73/00* (2013.01); *D06F 75/16* (2013.01); *D06F 75/20* (2013.01); *D06F 75/30* (2013.01); *D06F 87/00* (2013.01)

(58) Field of Classification Search

CPC ..... D06F 75/32; D06F 75/16; D06F 75/20; D06F 75/30; D06F 75/00; D06F 75/38; D06F 75/36; D06F 73/00; D06F 87/00

See application file for complete search history.

(56) References Cited

U.S. PATENT DOCUMENTS

| | | | |
|---|---|---|---|
| D106,361 | S | 10/1937 | Von Schrader |
| D222,502 | S | 10/1971 | Madl |
| 3,620,055 | A | 11/1971 | Blachly et al. |
| 3,646,317 | A | 2/1972 | Osrow |
| 3,675,449 | A | 7/1972 | Bluestein |
| D229,016 | S | 11/1973 | Plasko |
| D229,664 | S | 12/1973 | Stutzer |
| D255,864 | S | 7/1980 | Bennett |
| D262,257 | S | 12/1981 | Sohn |
| 4,399,349 | A | 8/1983 | Deming et al. |

(Continued)

FOREIGN PATENT DOCUMENTS

KR 20-0369458 Y1 12/2004

OTHER PUBLICATIONS

International Search Report dated Apr. 1, 2021 from corresponding International Patent Application No. PCT/US2021/013383, 4 pages.

(Continued)

*Primary Examiner* — Ismael Izaguirre

(74) *Attorney, Agent, or Firm* — Ruggiero, McAllister & McMahon, LLC

(57) ABSTRACT

A handheld appliance delivers heat and steam to a clothing garment or fabric. The appliance has a housing that contains a removable water reservoir, a pump, a control board, and a steam generator. The steam generator has a steam outlet that is a single nozzle connected to one of a plurality of output heads are interchangeably connected. Each output head has a steam outlet of different configurations to selectively vary one or more of steam emission pressure, steam emission distance and steam emission area. One or more output heads include physical components for direct contact with the garment or fabric.

15 Claims, 14 Drawing Sheets

(56) References Cited

U.S. PATENT DOCUMENTS

| | | | | |
|---|---|---|---|---|
| 4,496,826 | A | 1/1985 | Osrow | |
| 4,536,977 | A | 8/1985 | Doyel | |
| 4,571,483 | A | 2/1986 | Fathi | |
| 4,583,260 | A | 4/1986 | Zai | |
| D319,121 | S | 8/1991 | Muller | |
| 5,235,759 | A * | 8/1993 | Rizzuto, Jr. | A45D 20/122 239/393 |
| 5,420,961 | A * | 5/1995 | Walker | A45D 44/00 392/403 |
| 5,651,201 | A | 7/1997 | Farley | |
| D426,924 | S | 6/2000 | Joiner et al. | |
| D436,424 | S | 1/2001 | Buzzi | |
| 6,275,653 | B1 | 8/2001 | Montipo' | |
| 6,986,217 | B2 | 1/2006 | Leung et al. | |
| D516,759 | S | 3/2006 | Lam | |
| D525,399 | S | 7/2006 | Alday Lesaga | |
| 7,155,117 | B2 | 12/2006 | Leung et al. | |
| D540,498 | S | 4/2007 | Tobias | |
| D542,488 | S | 5/2007 | Lee | |
| D576,363 | S | 9/2008 | Reiner | |
| 7,490,422 | B1 | 2/2009 | Chen | |
| D589,663 | S | 3/2009 | Massip et al. | |
| D592,365 | S | 5/2009 | Massip et al. | |
| D601,806 | S | 10/2009 | Choi | |
| 7,661,212 | B2 | 2/2010 | Hahn | |
| D622,457 | S | 8/2010 | Choi | |
| D646,029 | S | 9/2011 | Choi | |
| D646,445 | S | 10/2011 | Choi | |
| D648,494 | S | 11/2011 | Vrdoljak | |
| D648,495 | S | 11/2011 | Ediger et al. | |
| D648,908 | S | 11/2011 | Ediger et al. | |
| D651,774 | S | 1/2012 | Tobias et al. | |
| 8,156,667 | B2 | 4/2012 | Liu | |
| D670,876 | S | 11/2012 | Vrdoljak et al. | |
| 8,800,163 | B2 * | 8/2014 | Schmid | A45D 19/02 34/287 |
| 8,893,410 | B2 | 11/2014 | Vrdoljak et al. | |
| D725,326 | S | 3/2015 | Spencer et al. | |
| D731,723 | S | 6/2015 | Dammkoehler et al. | |
| D776,887 | S | 1/2017 | Deffrennes | |
| 9,845,568 | B2 | 12/2017 | Fung | |
| D808,600 | S | 1/2018 | Malatray | |
| D826,492 | S | 8/2018 | Huang et al. | |
| D842,559 | S | 3/2019 | Yang et al. | |
| 10,570,560 | B2 | 2/2020 | Chua et al. | |
| D906,606 | S | 12/2020 | Zeng | |
| 2001/0030183 | A1 * | 10/2001 | Bowen | D06F 75/30 219/246 |
| 2004/0010950 | A1 | 1/2004 | Leung et al. | |
| 2006/0018638 | A1 | 1/2006 | Leung | |
| 2010/0024492 | A1 | 2/2010 | Leung | |
| 2010/0269287 | A1 | 10/2010 | Vrdoljak et al. | |
| 2015/0354128 | A1 | 12/2015 | Choo et al. | |
| 2016/0053430 | A1 | 2/2016 | Chua et al. | |
| 2016/0160434 | A1 | 6/2016 | Chua et al. | |
| 2016/0194816 | A1 | 7/2016 | Chua et al. | |
| 2016/0289889 | A1 * | 10/2016 | Lee | D06F 75/14 |
| 2017/0260685 | A1 * | 9/2017 | Fung | D06F 75/18 |
| 2017/0275809 | A1 * | 9/2017 | Javit | D06F 75/12 |
| 2018/0142883 | A1 | 5/2018 | Wadha et al. | |
| 2018/0371684 | A1 | 12/2018 | Ong et al. | |
| 2019/0234006 | A1 | 8/2019 | Yan et al. | |
| 2020/0362505 | A1 | 11/2020 | Razouki | |

OTHER PUBLICATIONS

Written Opinion dated Apr. 1, 2021 from corresponding International Patent Application No. PCT/US2021/013383, 12 pages.

"Conair Extreme Steam Hand Held Fabric Steamer Dual Heat, White/Blue" (Conair), Jan. 26, 2018 [online] retrieved from <URL: https://www.amazon.com/Conair_extreme-Steam-Fabric-Steamer/dp/B006CR9KGA?th-=1>, 13 pages.

Portable Garment Steamer https://www.alibaba.com/product-detail/HJ-3000-Portable-Garment-Steamer-Handheld_60552204515.html (Year: 2020).

Hand-held Garment Steamer https://www.amazon.com/Reliable-Dash-150GHB-Garment-Steamer/dp/B07Z6MF3QQ (Year: 2020).

* cited by examiner

FABRIC STEAMER APPARATUS

BACKGROUND OF THE DISCLOSURE

1. Field of the Disclosure

The present disclosure relates to a hand-held appliance for the care of clothing and other articles made of a textile or fabric. More particularly, the present disclosure relates to such a hand-held appliance that delivers heat and/or steam to clothing, textiles, fabrics and the like for removing wrinkles and for cleaning.

2. Description of the Related Art

Handheld appliances for applying steam to remove wrinkles from, to clean, and to deodorize fabrics, such as clothing garments, draperies, upholstery, and other items, are generally known. In such appliances, water is placed in a reservoir and heated to produce steam and that steam is emitted through a nozzle that a user directs toward the fabric.

Typical appliances usually have multiple steam outlet openings to form an aggregate steam output area. The steam outlets may be multiple holes or multiple slots. Such known designs usually have relatively low pressure steam emissions over a relatively wide steam output area. This results in a relatively short distance of travel of the emitted steam and a relatively low-pressure stream of steam. In situations where it is desired to precisely aim a concentrated application of high pressure steam to remove a stubborn wrinkle or stain from fabric, such known designs sometimes have unsuccessful results.

SUMMARY

The present disclosure provides a handheld appliance which delivers heat and/or steam to fabric in a manner in which steam is emitted through a concentrated, small, single opening In a preferred embodiment of the present disclosure, a handheld appliance delivers heat and/or steam to fabric in a manner in which steam is emitted through a concentrated, small, single opening so that the emitted jet of steam has a relatively high-pressure, small diameter spray pattern. This concentrated jet of steam contacts a fabric with more force and heat than a typical handheld steam appliance, and it covers a smaller and more precise target surface area on the fabric. A set of interchangeable steam emission output heads according to the preferred embodiment enables users to select from a variety of resultant steam spray patterns, distances, forces and heat concentration.

The present disclosure further provides one or more sensors associated with a corresponding output head in order to detect the presence of the respective output head.

The present disclosure further provides a control board that controls and adjusts operations of the appliance such as, for example, the steam generator, based on the identity of the detected output head.

The present disclosure also provides output heads including a contactless wrinkle and odor removing tool, a direct contact brushing tool, and a direct contact ironing tool.

The appliance of the present disclosure provides means for adjustment of steam pressure for different garment steaming purposes through the use of interchangeable heads that alter steam outlet configurations and properties.

The present disclosure further provides for a garment steaming appliance having a compact size suitable for home use and for travel.

The appliance of the present disclosure has a housing that contains a removable water reservoir, a pump, a control board, and a steam generator. The steam generator has a steam outlet that is a single nozzle adapted to receive one of the interchangeable output heads. Multiple, interchangeable output heads are selectively attachable to the single nozzle. Each output head has a distinct steam outlet configuration in comparison to the others, so as to provide a user with various options for selectively controlling steam output emission distance, pressure, surface area and temperature, as well as options for cleaning or pressing through direct contact.

The above and other objects, features, and advantages of the present disclosure will be apparent and understood by those skilled in the art from the following detailed description, drawings, and accompanying claims. As shown throughout the drawings, like reference numerals designate like or corresponding parts.

DETAILED DESCRIPTION OF A PREFERRED EMBODIMENT

Figure 1:
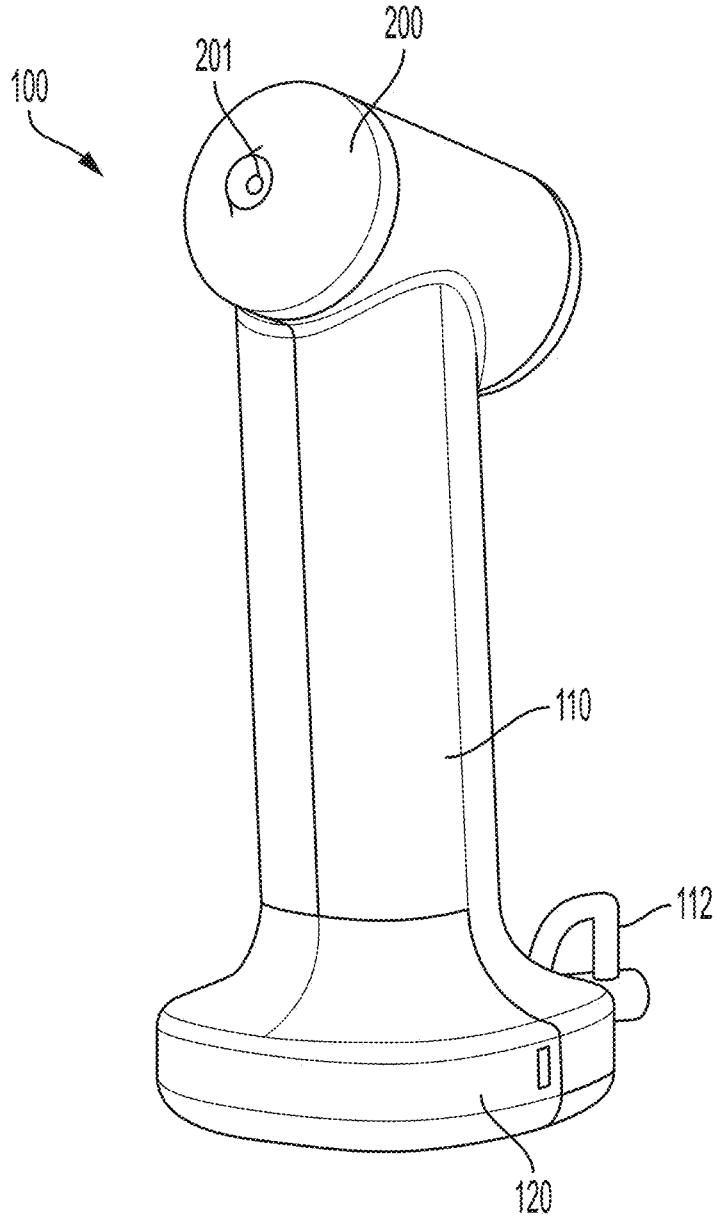
FIG. 1 is a perspective view of a preferred embodiment of a fabric steamer according to the present disclosure.

A fabric steamer 100 according to a preferred embodiment of the present disclosure is shown in FIG. 1.

Steamer 100 includes a body 110 having an elongated handle for grasping by a user and for housing of components, an electrical cord sleeve 112 for supplying power from an external power source to the steamer 100, a reservoir 120 for holding water to be converted to steam, and an interchangeable head 200 through which steam is discharged or emitted. Head 200 has a central opening 201 through which steam is emitted. Head 200 can be used to remove odors on cloth and to de-wrinkle the cloth by concentrating a single, high-pressure jet of steam during use.

As will be discussed in more detail, head 200 is interchangeable with head 300 and head 400, all shown in FIG. 2A. Each head 200, 300, 400 can attach to the steam generator nozzle 142 of the steam generator 130.

Figure 2A:
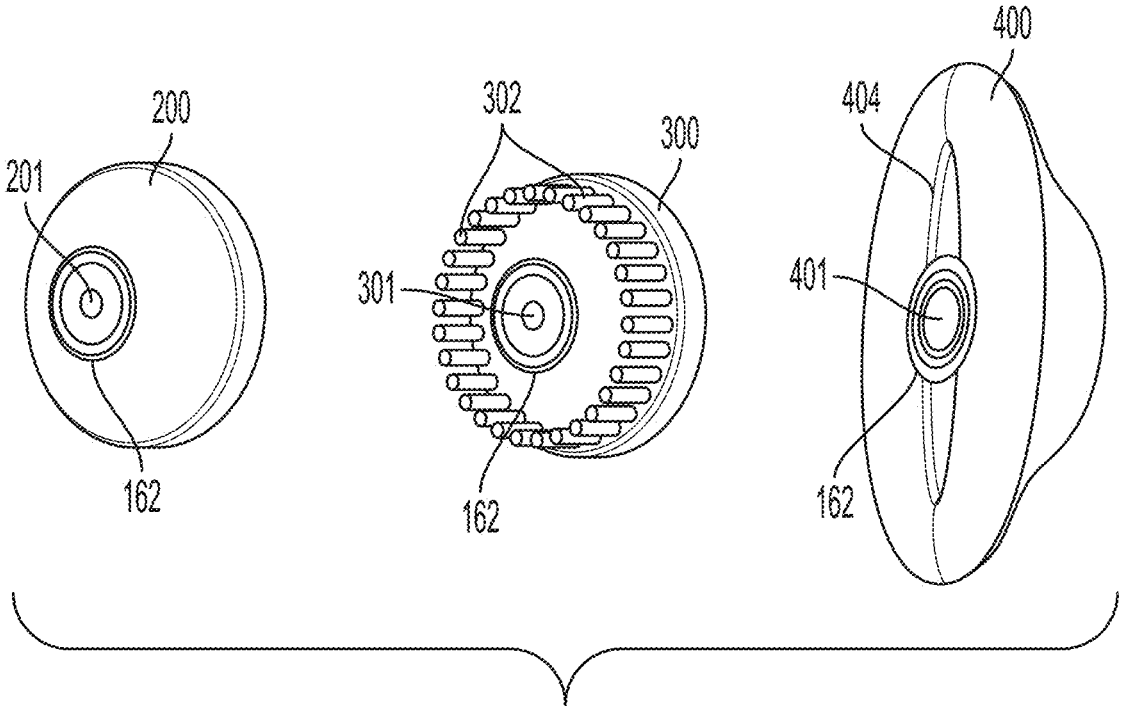
FIG. 2A is a perspective view of interchangeable heads for the fabric steamer.

Head 300 includes a set of bristles 302 in an array, preferably forming a circle as shown in FIG. 2A, so that head 300 can be used for cleaning solid and liquid stains on cloth fabric. As steam is emitted from the central opening 301 and aimed at a stained portion of fabric, a user can press the bristles 302 against the stained portion and apply movement to dislodge dirt or stain particles through brushing action in combination with heat and moisture from the steam.

Head 400 includes a soleplate 404 so that head 400 can be used for horizontal or vertical steam ironing. Soleplate 404 is preferably made of heat transmitting material, such as a metallic material, to absorb and redistribute heat from both the steam being emitted and the steam generator 130 components that are in close proximity to, or in contact with, soleplate 404. A single opening 401 in head 400 emits steam.

It should be appreciated that different applications, such as, removing odors and wrinkles on cloth; cleaning solid and liquid stains on cloth; horizontal or vertical steam ironing. Each require different steam pressures, steam areas, and steam distances to achieve appropriate functionality. Advantageously, the appliance of the present disclosure enables variable steam pressure, steam areas, and steam emission distances through the selective use of each respective head 200, 300, 400.

Figure 2B:
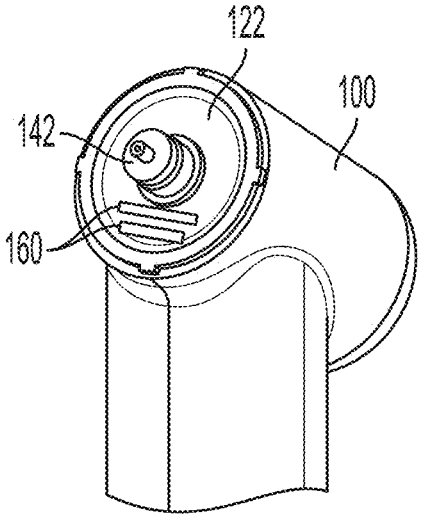
FIG. 2B is a perspective, partial view of the fabric steamer.

Referring to FIG. 2, one or more sensors 160 are mounted to the front housing 122 of steamer 100 to enable steamer 100 to recognize which one of the respective heads 200, 300, or 400 is attached. Each of the heads 200, 300, and 400 includes a detectable sensor component, such as a magnet 162, that is detected by sensor 160 to indicate the presence of the respective head. Sensor 160 can be a mechanical switch, such as a micro-switch, and can include electronic components such as an IR sensor and reed switch that communicate with heads 200, 300, 400 and provide a signal to circuit boards 138, 140 shown in FIG. 3.

Circuit boards 138, 140 can provide an indication of whether or not a head is attached, and which specific head is attached. It is also envisioned that circuit boards 138, 140 can provide different safety checks, preheat temperature or time settings, and control steam output based on recognition of which one of heads 200, 300, 400 is attached. Circuit boards 138, 140 can also provide a visual or audio indication that heads 200, 300, 400 are properly attached or not properly attached.

Figure 3:
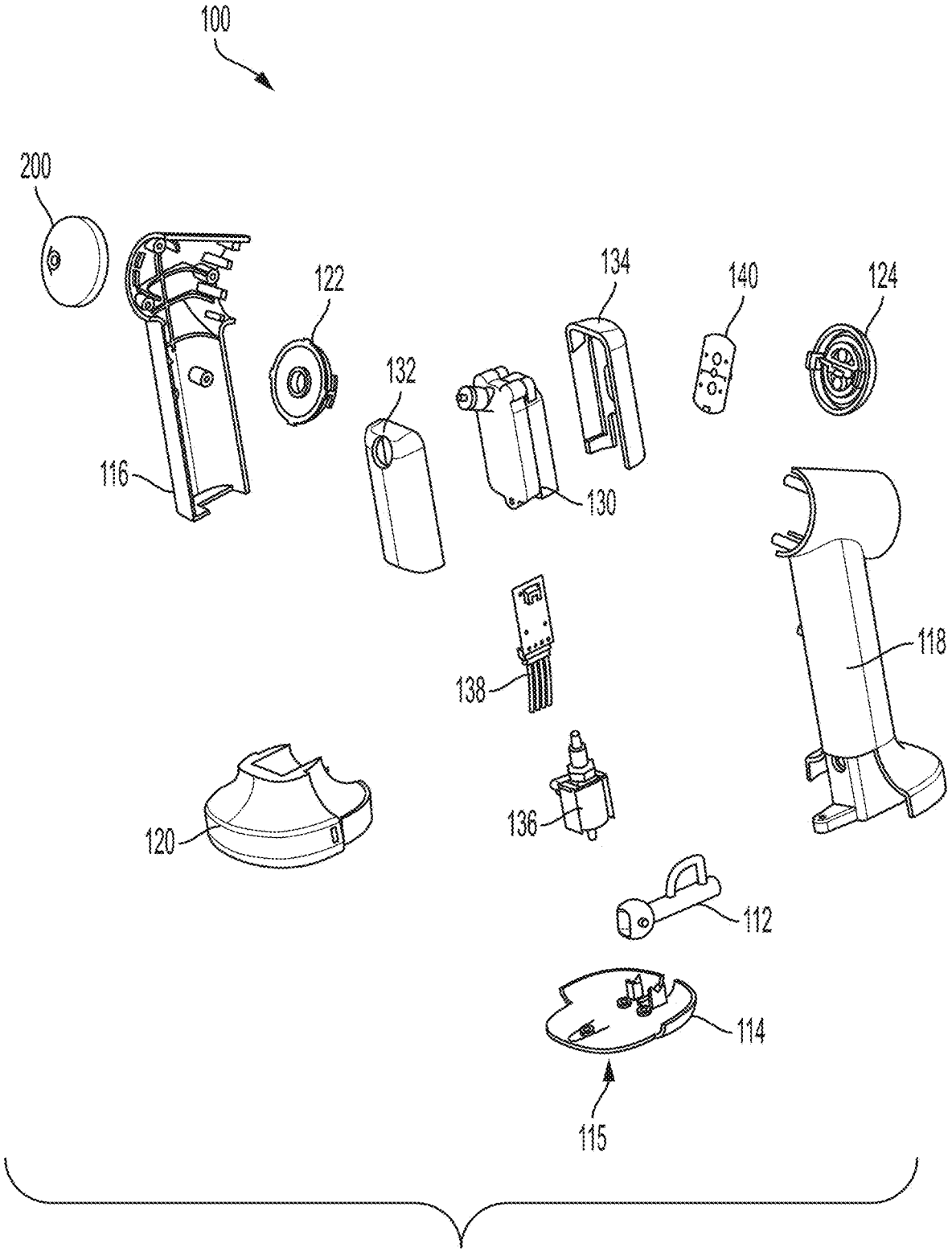
FIG. 3 is an exploded view of the components of the fabric steamer.
Figure 4:
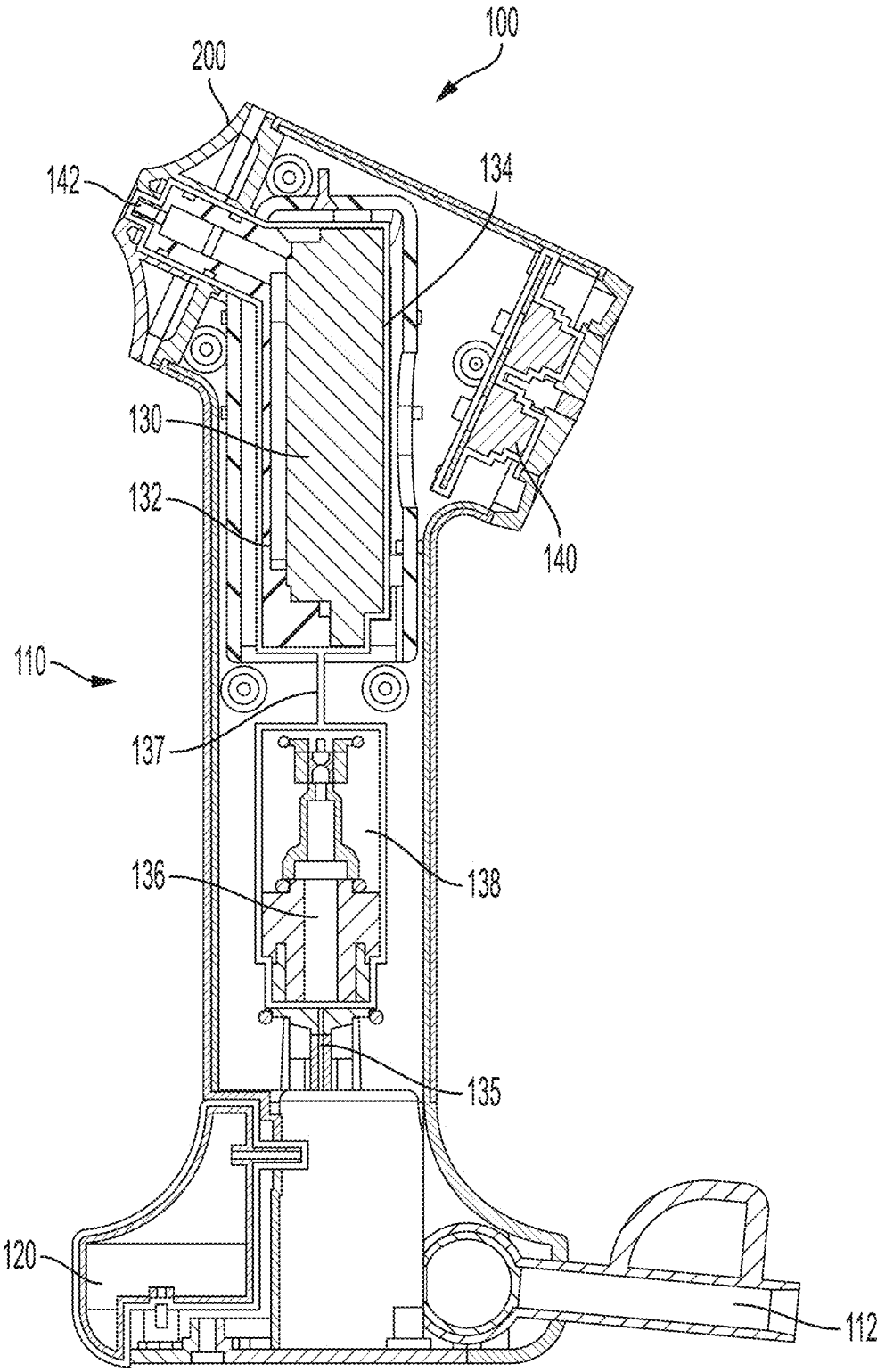
FIG. 4 is a cross sectional view of the fabric steamer with no head attached.

The main components of steamer 100 are shown in an exploded view in FIG. 3 and in the cross-sectional view of FIG. 4.

Body 110 includes a base or bottom housing 114, a left housing 116, a right housing 118, a front housing or component 122, and a cover 124 that together house a steam generator 130, one or more heat shields 132, 134, a pump 136, one or more circuit boards 138, 140, and a portion of electrical connection 112. Steam generator 130, the one or more heat shields 132, 134, pump 136, and the one or more circuit boards 138, 140 are in electrical or operative communication with each other. Although the preferred embodiment of steamer 100 has been illustrated as being powered by an external electrical source, steamer 100 can alternatively be powered by an internal power source such as a battery.

Reservoir 120 is supported on bottom housing 114. Pump 136 is positioned above reservoir 120, and a conduit 135 provides an operative connection therebetween so that water can be transported from the reservoir through the pump.

Steam generator 130 is a vessel heated by electrical energy in which water is heated therein to produce steam. Steam generator 130 can be a flash boiler that can produce steam almost instantaneously upon the introduction of water from pump 136. Steam generator 130 can include a safety device in the form of a thermal cut-off switch to prevent overheating. A conduit 137 operatively connects steam generator 130 to pump 136.

Surrounding steam generator 130 are heat shields 132, 134. Heat shields 132, 134 protect the internal components of steamer 100 from heat generated by steam generator 130.

Steam generated by steam generator 130 is discharged from a single nozzle 142 extending from the steam generator 130.

Figure 5A:
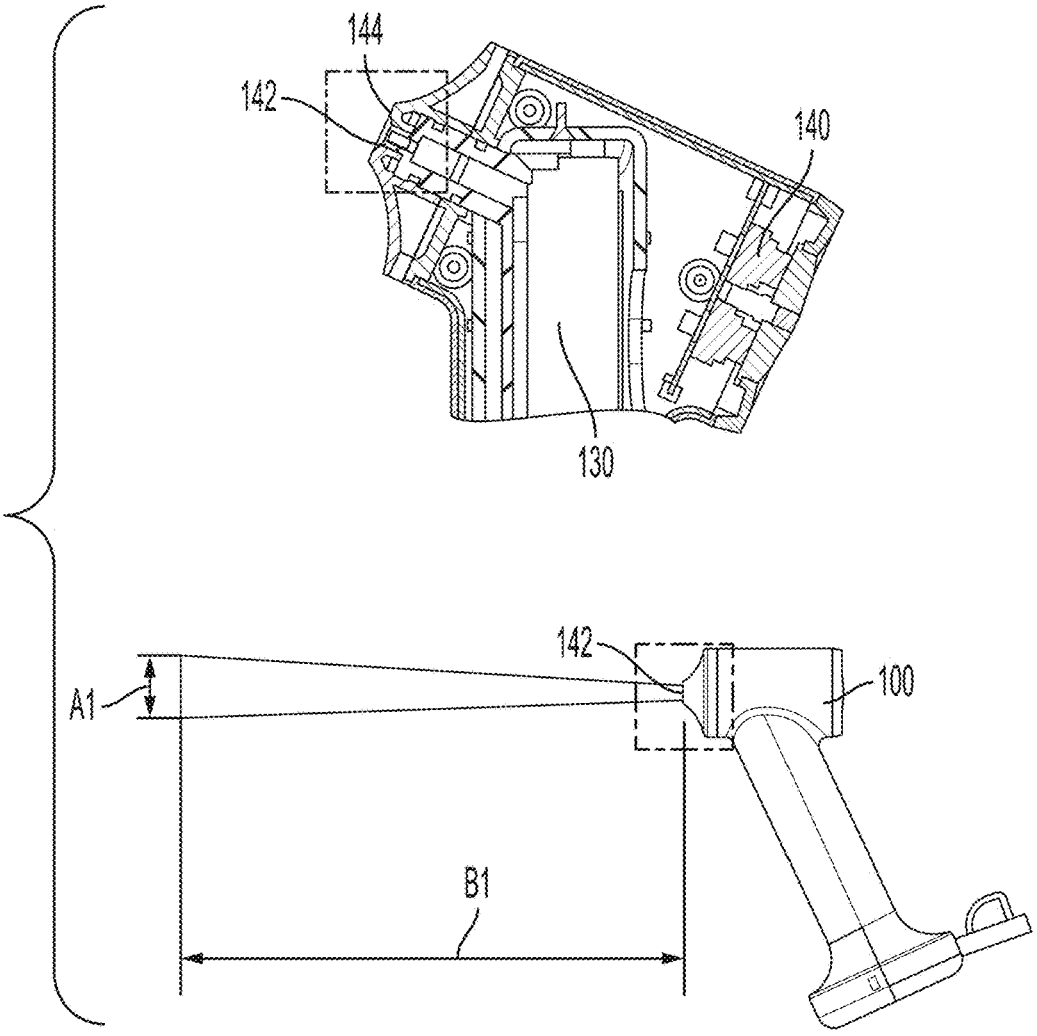
FIG. 5A is a schematic view illustrating steam emission distance and steam emission area of one mode of use of the fabric steamer of the present disclosure.
Figure 5B:
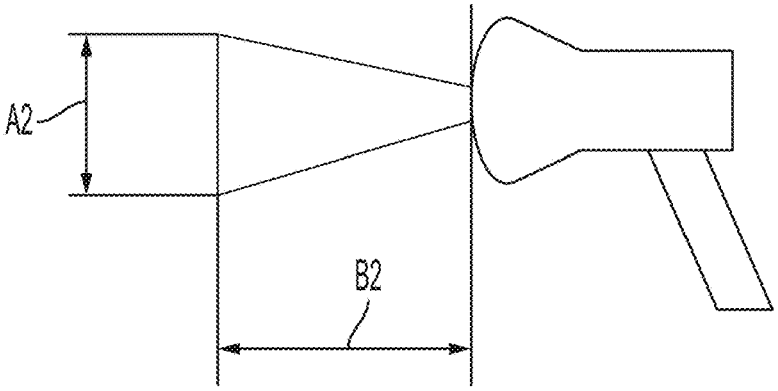
FIG. 5B PRIOR ART
FIG. 5B is a schematic illustrating steam emission distance and steam emission area of a prior art steam appliance.

FIG. 5A schematically illustrates the resultant steam spray pattern of present steamer 100 in terms of spray diameter A1 at a spray distance B1, in comparison to the resultant steam spray pattern of a prior art steamer shown in FIG. 5B having spray diameter A2 at a distance of B2. The prior art steamer, typically of a multiple outlet hole design, emits steam for a shorter distance B2 and at a wider diameter A2, with resulting lower pressure. In contrast, steamer 100 emits steam out of a single opening, thereby concentrating outflowing steam so that it emits at a higher pressure, resulting in a longer distance B1 and a wider diameter A1.

Figure 6:
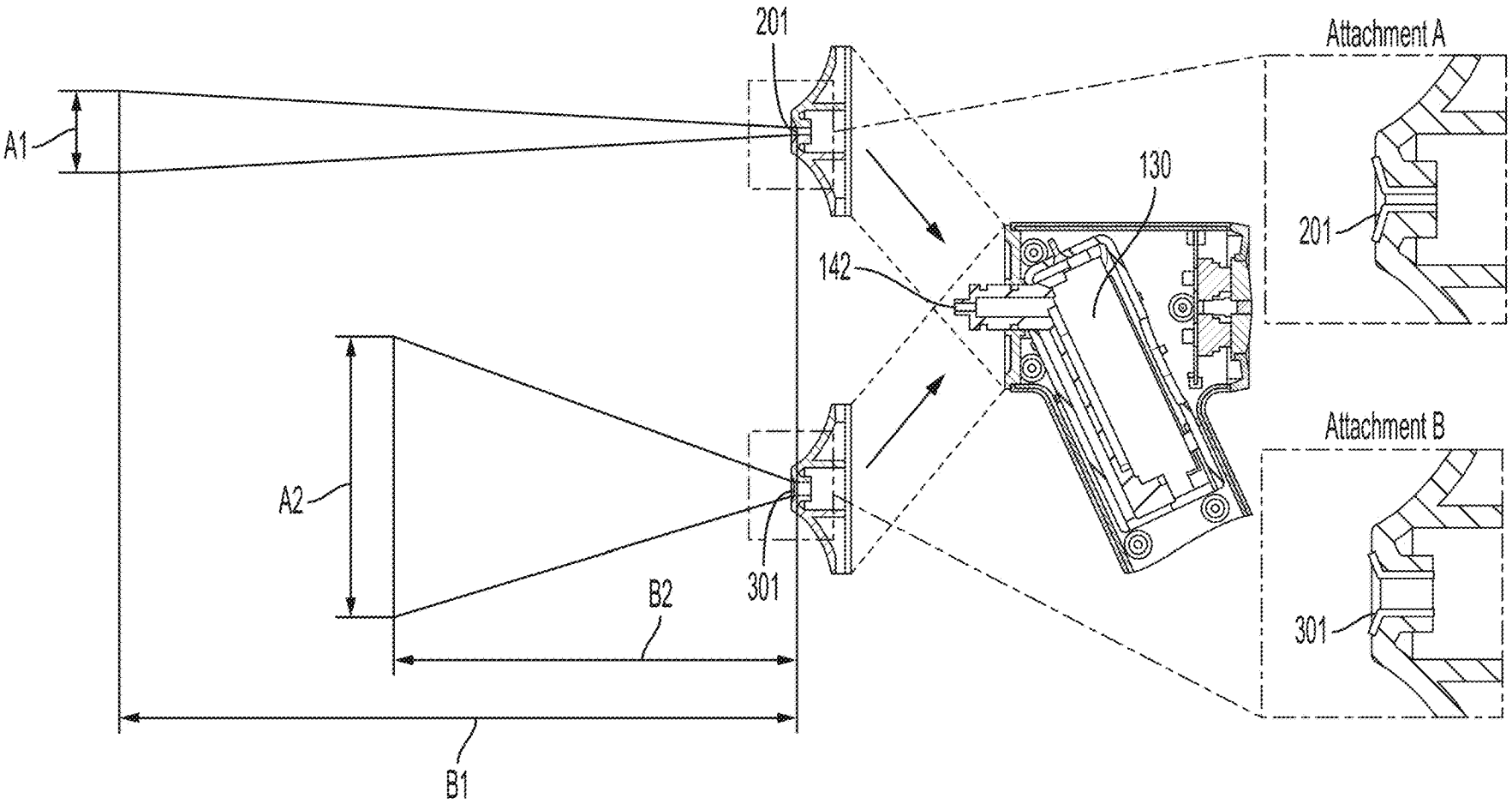
FIG. 6 is a schematic view comparing steam emission distance and steam emission area variations resulting from different interchangeable heads according to the present disclosure.

The operating principle of steam pressure adjustment in steamer 100 in accordance with the present disclosure is illustrated in FIG. 6. By way of illustrative example, Attachment A corresponds to head 200 and Attachment B corresponds to interchangeable head 300. Attachment A has a smaller diameter steam outlet 201 than nozzle 142 resulting in a relatively high-pressure, long-distance, small-area steam jet. Attachment B has a larger diameter steam outlet 301 than nozzle 142, resulting in a relatively low-pressure, short-distance, large-area steam jet. The schematic dimensions shown as A1 and A2 represent, respectively, the diameters of the steam jet for each of Attachment A and Attachment B, each at distance B1 and distance B2, respectively. The steam pressure can be selectively determined for a specific application by selecting and attaching one of interchangeable heads 200, 300, and 400. Heads 200, 300, and 400 have a different steam outlet designs to achieve the application specific steam pressure adjustment, when attached to steamer 100.

Figure 7:
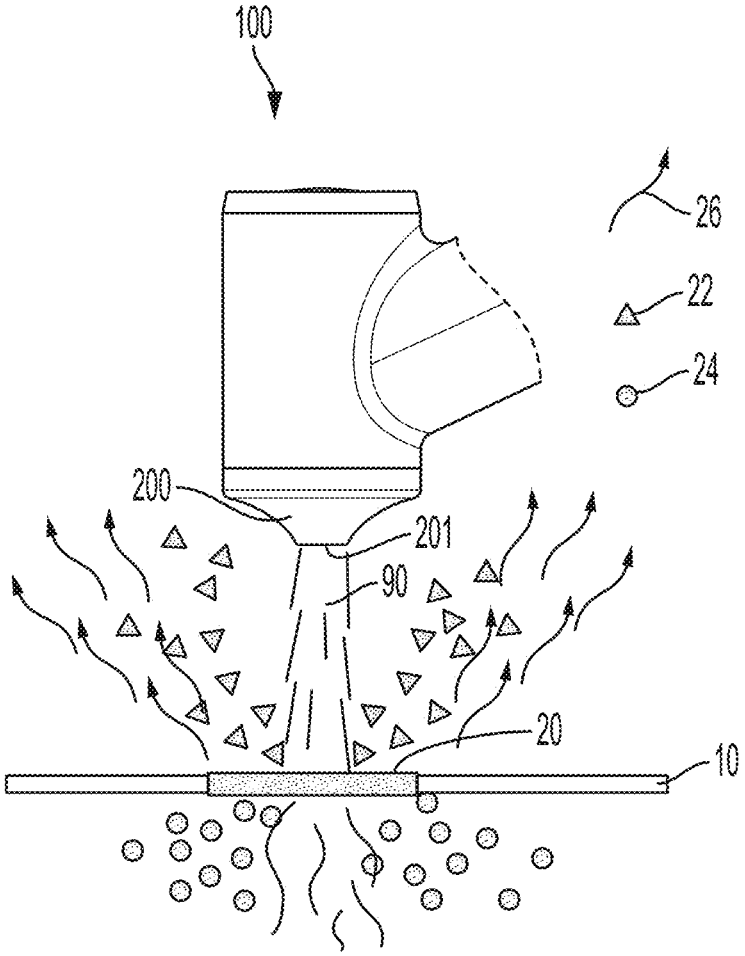
FIG. 7 is a schematic illustration of the present disclosure steamer used for odor removal from a horizontally disposed fabric.

Referring to FIG. 7, steamer 100 having head 200 attached is shown and is used to direct steam to a garment or cloth 10. Cloth 10 has a target area 20 having one or more odorous substance particles schematically illustrated by numerals 22 and 24 on the cloth surface.

When steamer 100 is activated, high pressure steam 90 is emitted from steam outlet 201 onto target odor removal area 20. Arrows 26 indicate direction of movement of substance particles 22, 24 in response to application of emitted steam.

The high pressure steam 90 creates high frequency vibrations on the surface of cloth which facilitates cleaning of both solid stains and surface dust. The high temperature of the steam denatures and/or kills organic matter that may cause odors.

Figure 8A:
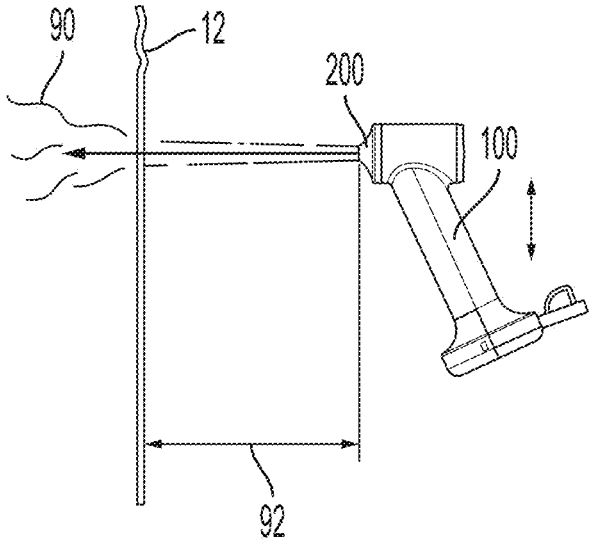
FIGS. 8A-8B illustrate use of the present disclosure steamer for odor removal from a vertically disposed fabric.
Figure 8B:
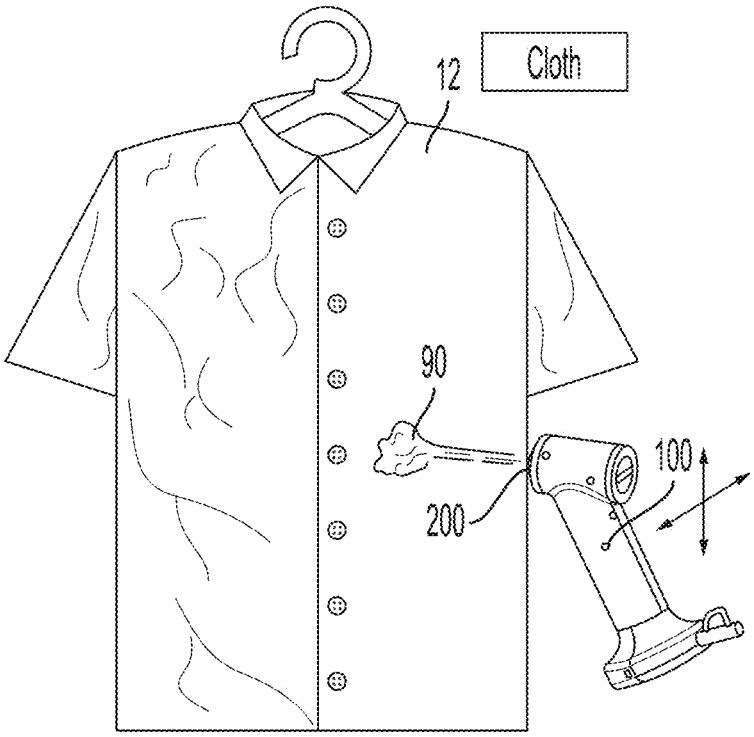

Referring to FIGS. 8A-8B, steamer 100 is used to remove wrinkles from a garment 12. Wrinkles are removed from garment 12 by hanging or suspending garment 12 vertically and moving steamer 100 in close proximity to garment 12 so that steam 90 is emitted, preferably perpendicularly, to a surface of cloth 12. It is not necessary that any portion of steamer 100 is in direct physical contact with the garment 12, as it is sufficient to hold steamer 100 at a distance 92 to remove wrinkles in this application. The distance 92 is preferably from 1 cm to 30 cm, more preferably from 1 cm to 20 cm, and most preferably from 2 cm to 5 cm.

Figure 9A:
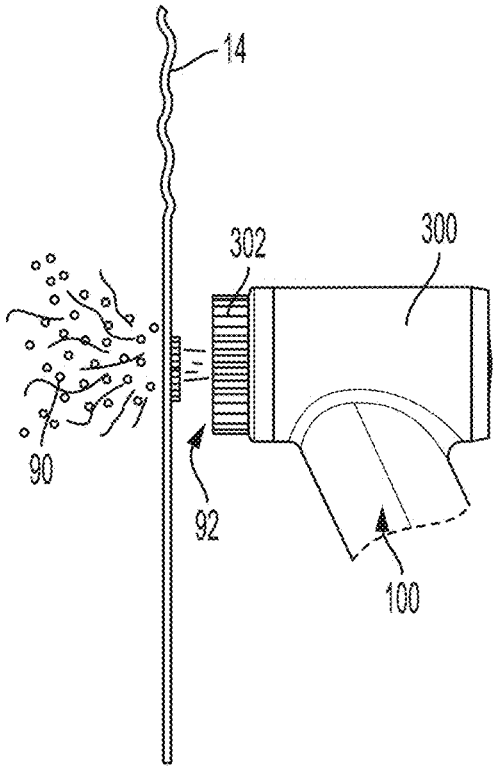
FIGS. 9A-9B illustrate use of the present disclosure steamer for stain removal from a fabric.
Figure 9B:
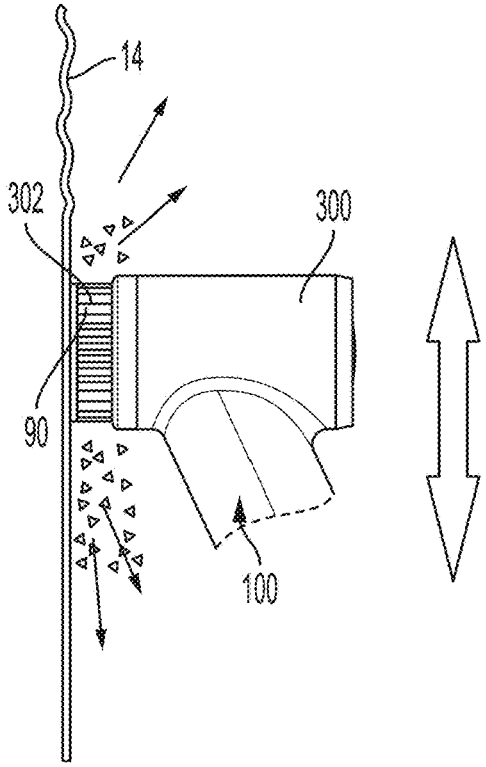

Referring to FIGS. 9A-9B, head 300 is attached to steamer 100 to physically scrub and remove stains from a cloth garment 14. It can be used as a cleaning method or as a pre-treatment prior to, for example, placing the garment in a washing machine.

As shown in FIG. 9A, steam 90 is emitted onto the garment 14 so that it contacts and penetrates the garment 14. Some stain particles are removed by the heat and pressure of the steam action alone. As shown in FIG. 9B, bristles 302 are brought into contact with the garment 14 and used to scrub and loosen stain particles so that the particles fall away or are carried off by the steam 90 as it passes through.

Figure 10A:
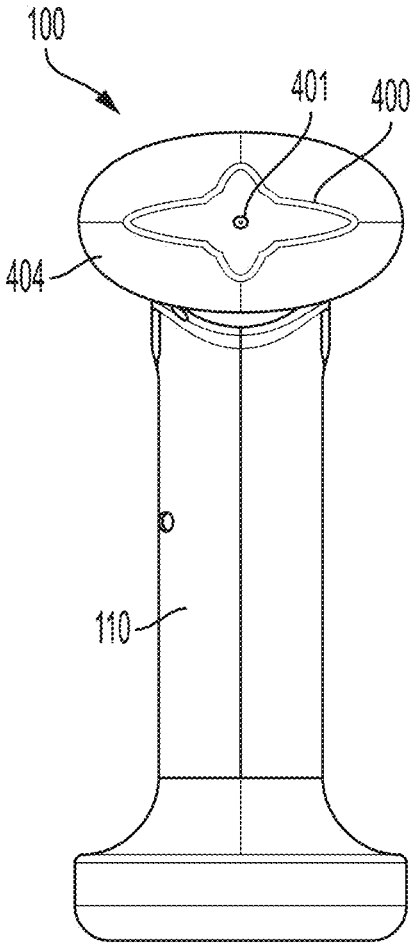
FIGS. 10A-10B illustrate vertical and horizontal configurations of an interchangeable head on a steamer according to the present disclosure.
Figure 10B:
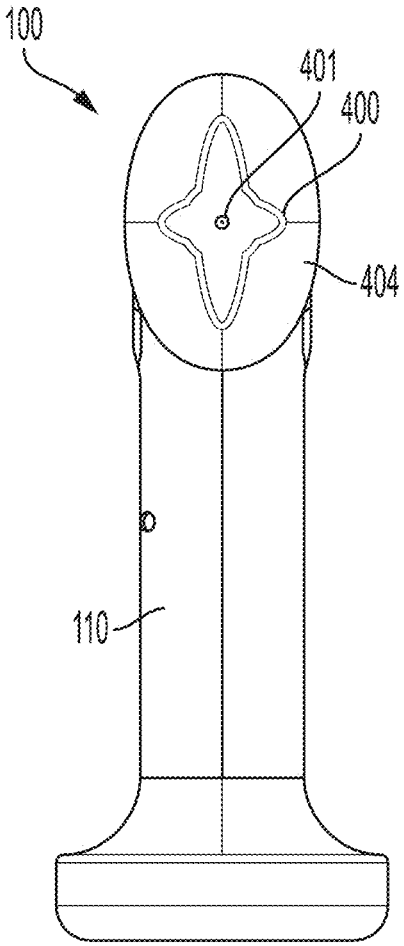
Figure 11A:
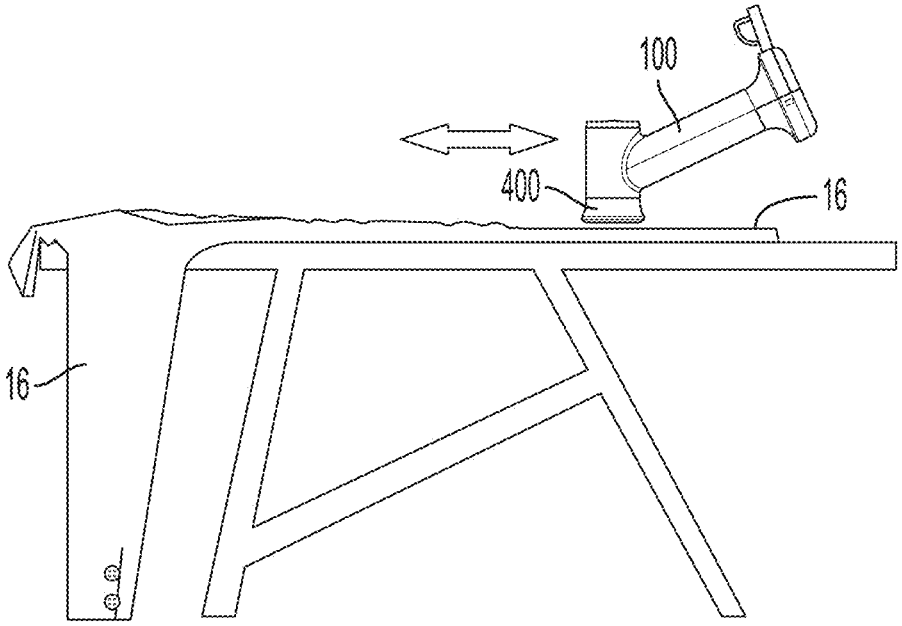
FIG. 11A illustrates a direct contact ironing operation on a horizontal ironing surface using an interchangeable head for ironing according to the present disclosure.
Figure 11B:
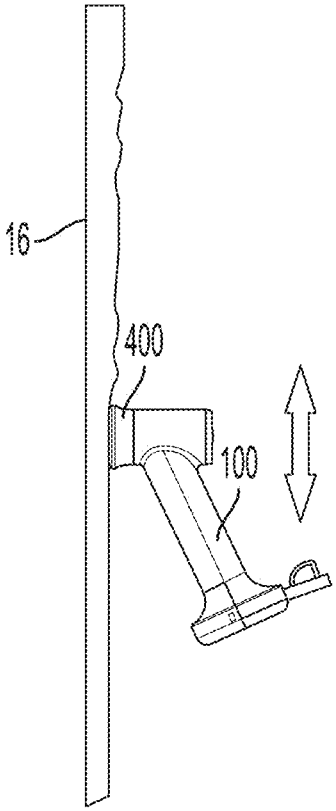
FIG. 11B illustrates a direct contact ironing operation on a vertical ironing surface using an interchangeable head for ironing according to the present disclosure.

Referring to FIGS. 10A-10B and 11A-11B, head 400 includes a soleplate 404 that is used for direct-contact steam ironing operations. Head 400 has a smooth surfaced soleplate 404 made of a heat conductive material for distributing heat to a garment to be iron. Head 400 can be attached to steamer 100 in either a horizontal orientation as shown in FIG. 10A or a vertical orientation as shown in FIG. 10B. Each orientation is selected for a specific use, such covering a wide surface area or reaching a small surface area. Soleplate 404 can be used to iron garments that are flat as shown in FIG. 11A or that are suspended vertically as shown in FIG. 11B.

Figure 12A:
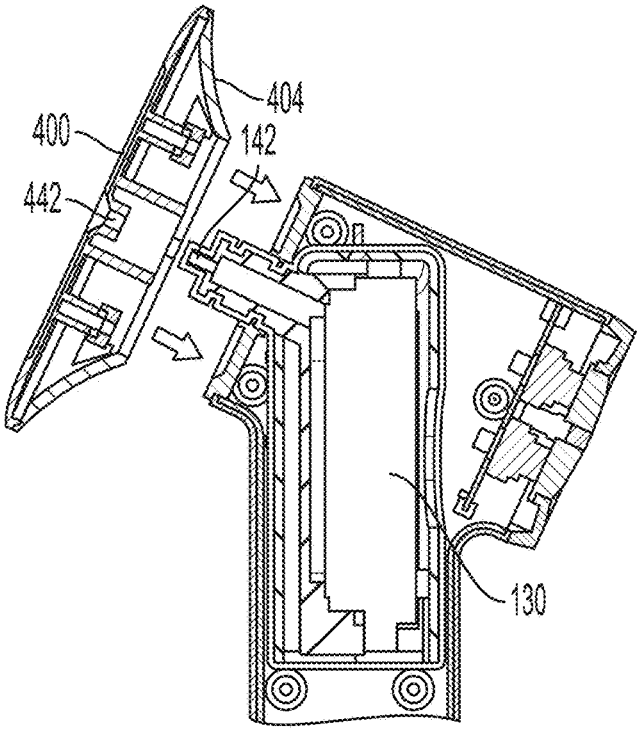
FIGS. 12A-12B illustrate attachment of a an interchangeable head and resultant steam flow paths according to the present disclosure.
Figure 12B:
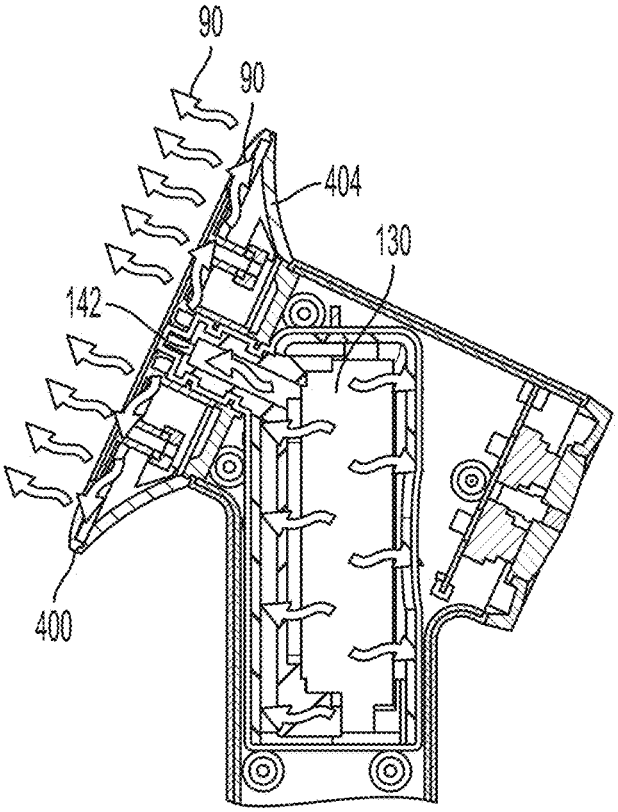

Referring to FIGS. 12A-12B, heat is transferred to soleplate 404 by steam passing from steam generator 130 through steam outlet 142, with which the soleplate 404 is in close proximity with when attached to steamer 100. Suitable materials for soleplate 404 are those having good heat conducting properties to distribute heat evenly and resist corrosion include aluminum, ceramic, stainless steel, titanium, and cast iron.

Figure 13:
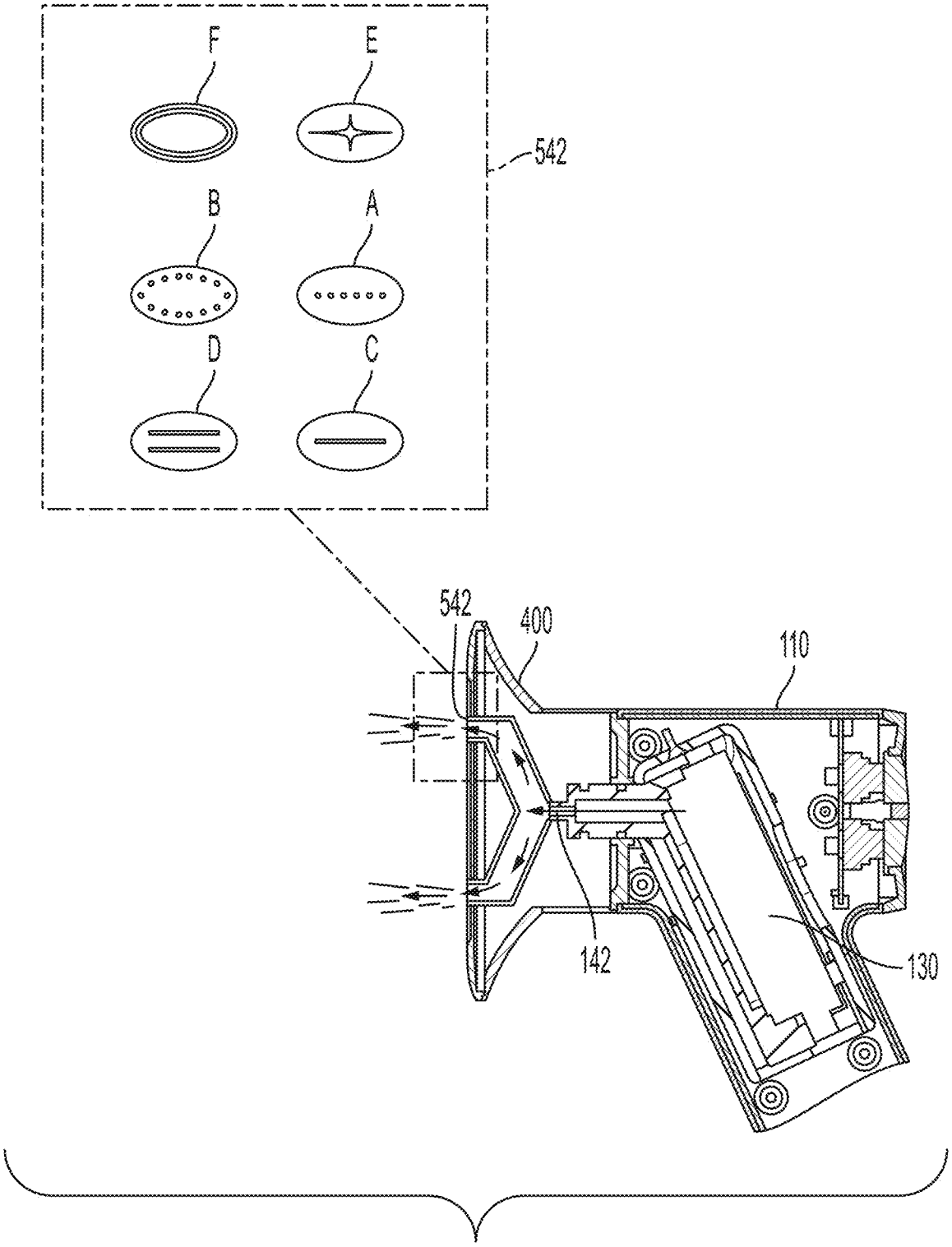
FIG. 13 is a schematic illustration of various steam outlet configurations for interchangeable heads according to the present disclosure.
Figure 14A:
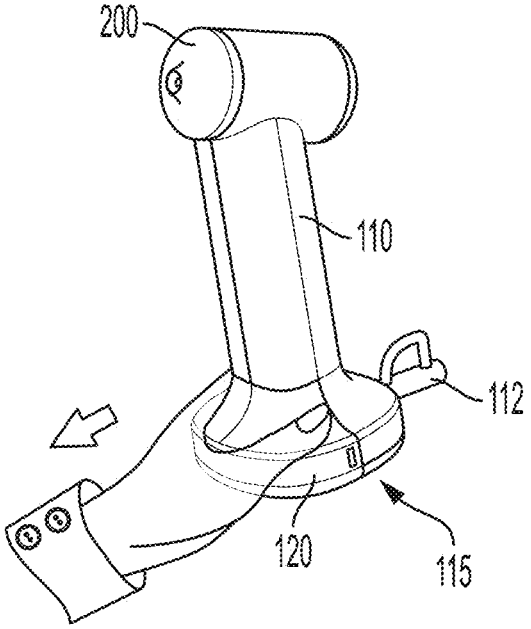
FIGS. 14A-14D are schematic illustrations showing filling and use of the water tank feature of the present disclosure fabric steamer.
Figure 14B:
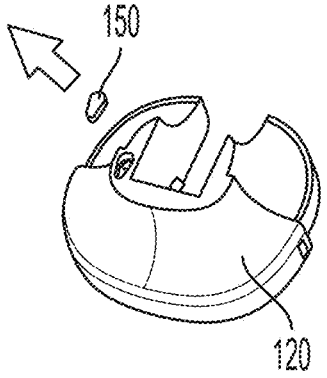
Figure 14C:
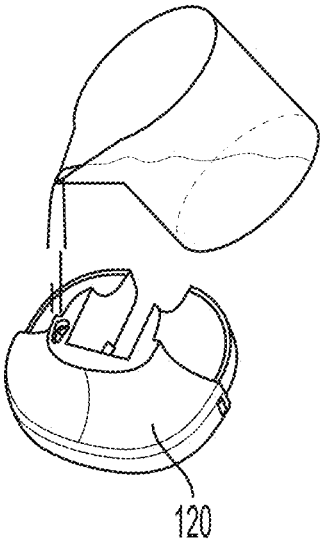
Figure 14D:
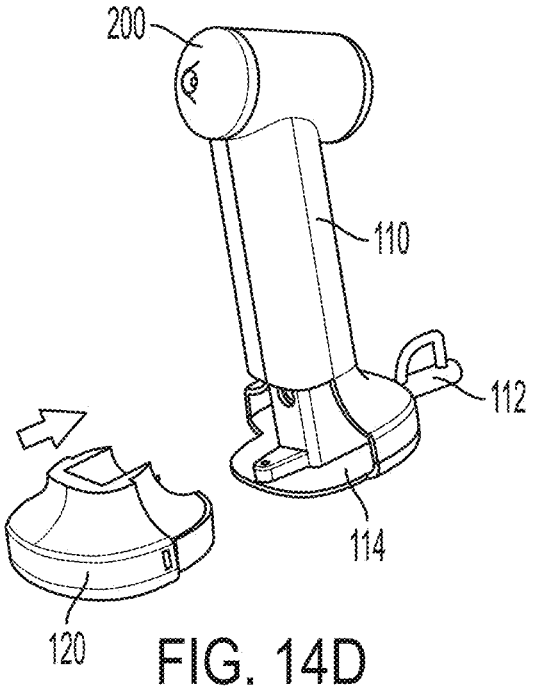

As shown in FIG. 13, variously configured alternative heads having steam outlets 542 of different shapes, dimensions and hole quantities can be used with the present steamer 100.

Steam outlets 542 are designed to suit different garment ironing purposes. For example, steam outlets corresponding to the examples 542 could be designed to have a plurality of holes arranged in a line (A), a plurality of holes arranged in an oval pattern (B), a slit opening (C), a plurality of slits (D), a star (E), or a continuous, oval line opening (F).

As shown in FIGS. 14A-14D, reservoir 120 is removably attached to the housing and slides out of bottom housing 114 so that water can be added. After removing a cover 150 from and filling or refilling reservoir 120, the cover is placed back on and reservoir 120 is again attached to bottom housing 114.

The bottom surface 115 of the bottom housing 114 is, preferably, generally flat and of sufficient surface area so as to enable steamer 100 to be supported vertically in a freestanding manner when the bottom surface 115 is placed on a flat surface, such as a tabletop.

While the present disclosure has been described with reference to one or more exemplary embodiments, it will be understood by those skilled in the art, that various changes can be made, and equivalents can be substituted for elements thereof without departing from the scope of the present disclosure. In addition, many modifications can be made to adapt a particular situation or material to the teachings of the present disclosure without departing from the scope thereof. Therefore, it is intended that the present disclosure will not be limited to the particular embodiments disclosed herein, but that the disclosure will include all aspects falling within the scope of a fair reading of appended claims.

What is claimed is:

1. A handheld appliance for emitting steam to treat a fabric, the appliance comprising:

a housing having a removable water reservoir, a pump, and a steam generator operatively connected to the pump, wherein the steam generator has a first steam outlet associated with a single nozzle having a first diameter; and a plurality of output heads that are interchangeably connectable to the single nozzle, each output head having a steam outlet with a differently sized steam outlet diameter that is either the same as or different than the first diameter so that one or more of steam pressure, steam emission distance and steam emission area of the appliance are adjustable by selecting and attaching one of the plurality of output heads to the appliance so that a respective one of the steam outlets is in communication with the first steam outlet of the single nozzle.

2. The appliance of claim 1, wherein at least one of the plurality of output heads comprises a tool for contacting the fabric to be treated.

3. The appliance of claim 2, wherein the tool is a soleplate or a brush.

4. The appliance of claim 3, wherein the soleplate is elliptical and can be mounted to the steam generator in a plurality of directional orientations.

5. The appliance of claim 1, wherein one or more of the output heads has a plurality of steam outlets.

6. The appliance of claim 5, wherein the plurality of steam outlets is selected from a group consisting of: a plurality of holes, a plurality of holes arranged in a line, a plurality of holes arranged in a circle or oval, and a plurality of slits.

7. The appliance of claim 5, wherein the steam outlet of each output head is selected from a group consisting of: a slit, a single oval or circular groove, and a star.

8. The appliance of claim 1, further comprising a sensor attached to the appliance housing and associated with one or more sensing components attached to one or more of the output heads.

9. The appliance of claim 1, further comprising a control board.

10. The appliance of claim 8, wherein the sensor detects the presence of one of the plurality of output heads.

11. The appliance of claim 10, wherein the control board adjusts a temperature of the steam generator based on characteristics associated with the detected output head.

12. The appliance of claim 1, wherein the housing has a bottom surface that is generally flat and adapted to be rested on a flat surface to support the appliance in a freestanding position when not in use.

13. The appliance of claim 1, wherein at least one of the heads has a plurality of bristles.

14. A handheld appliance for emitting steam, the appliance comprising:

a housing having a removable water reservoir, a pump, a control board and a steam generator operatively connected to the pump, wherein the steam generator has a first steam outlet associated with a single nozzle having a first diameter; and a plurality of output heads that are interchangeably connectable to the single nozzle, each output head having a steam outlet with a differently sized steam outlet diameter that is either the same as or different than the first diameter so that one or more of steam pressure, steam emission distance and steam emission area of the appliance are adjustable by selecting and attaching one of the plurality of output heads to the appliance so that a respective one of the steam outlets is in communication with the first steam outlet of the single nozzle;

one or more sensors in the housing that detect attachment of an output head to the housing, wherein the control board adjusts a temperature of the steam generator based on the detected, specific output head.

15. The appliance of claim 14, wherein the output heads are selected from the group consisting of: a non-contact tool, a brushing tool, and an ironing tool.

* * * * *